US006392315B1

(12) United States Patent
Jones et al.

(10) Patent No.: US 6,392,315 B1
(45) Date of Patent: May 21, 2002

(54) COMPENSATION CIRCUIT FOR AN AUTOMOTIVE IGNITION SENSING SYSTEM

(75) Inventors: Gregory Lynn Jones, Carmel; Thomas Alton Peterson, Kokomo; Paul D. Koottungal, Indianapolis; Terrell Anderson, Carmel, all of IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/285,663

(22) Filed: Apr. 5, 1999

(51) Int. Cl.[7] ..... F02P 9/00
(52) U.S. Cl. ..... 307/10.6; 123/597; 123/605
(58) Field of Search ..... 307/10.6, 10.1; 123/335, 597, 210, 406.11, 605; 324/388, 380; 327/110

(56) References Cited

U.S. PATENT DOCUMENTS 3,563,219 A * 2/1971 Mieras ..... 123/335
4,684,896 A * 8/1987 Weishaupt ..... 324/399
5,159,912 A * 11/1992 Klein et al. ..... 324/388
5,781,047 A * 7/1998 Shreve et al. ..... 327/110

* cited by examiner

*Primary Examiner*—Albert W. Paladini
(74) *Attorney, Agent, or Firm*—Jimmy L. Funke

(57) ABSTRACT

In a vehicle having an engine and an ignition system, a sensing circuit is provided for sensing the ignition voltage and providing this sensed signal to various operating modules of the vehicle. The sensing circuit includes a diode/resistor filter that provides a filtered voltage signal at a first output node. A compensation circuit is provided that compensates voltage errors introduced by the filter circuit. The compensation circuit includes a second diode that has substantially identical electrical performance characteristics as the first diode, and that is preferably mounted on a common substrate. A voltage signal at a second output node between the second diode and the filter circuit is indicative of the voltage drop across the second diode, which is further representative of the voltage error introduced by the filter circuit. In one embodiment, the operating module receiving the ignition voltage signal is configured to receive voltage signals at the first and second output nodes. The operating module can include a microprocessor that receives the A/D converted voltage signals and subtracts the signal at the second output node from the signal produced by the filter circuit according to a predetermined relationship. The result of this subtraction is then utilized by other software functions of the operating module that depend upon the ignition voltage signal.

13 Claims, 1 Drawing Sheet

COMPENSATION CIRCUIT FOR AN AUTOMOTIVE IGNITION SENSING SYSTEM

TECHNICAL FIELD

The present invention concerns automotive electrical systems, and particularly circuits within that system for sensing and utilising an ignition voltage signal. More specifically, the invention concerns a circuit for compensating errors in the sensed ignition voltage signal.

BACKGROUND OF THE INVENTION

Automotive control systems have become progressively more sophisticated. Most new vehicles rely upon many microprocessors or micro controllers for controlling various aspects of the vehicle function. One typical vehicle electrical system 10 as shown in FIG. 1. The system includes a power supply 11, which is typically the vehicle battery. A power bus 16 connects the battery to a number of electrical and electronic components. For example, the battery feeds power through the ignition switch 15, as well as to a power mode controller 17, and a radio 18. In addition, ancillary control modules are connected to the power bus 16, such as a power train control module 20, an airbag control module 21, an antilock braking system module 24, and additional customer supplied modules 22 and 23.

Each of these components performs various functions in the vehicle control system. For instance, the power mode module 17 is also sometimes referred to as a "body computer" because it controls various active suspension and vehicle body functions. The power train module 20 provides control signals to components within the vehicle power train. The airbag control module 21, also known as the sensing and diagnostics module, controls the operation of forward and side airbags associated with the vehicle. The ABS module 24 includes a micro controller that provides control signals to the antilock or anti-skid braking system. Finally, the additional modules 22 and 23 can include microprocessors or micro controllers that perform other customer-selected vehicles and/or engine functions.

Although all of the modules within the electrical system 10 are supplied with power directly from the battery 11, the initiation of these modules can frequently depend upon the ignition state of the vehicle. Most vehicle ignition switches, such as the switch 15, have many operating positions. For example, the ignition switch 15 can be moved to an IGN1 position which is activated when the vehicle engine is in the run or crank mode. Alternatively, the ignition switch can be moved to an "accessory position" in which a signal is provided on line 26. A third possible position for the ignition switch 15 is a "crank" position in which the vehicle engine is being cranked prior to actually starting. In this condition, the ignition switch provides a signal on line 27 that can be used by the power train control module 20 to perform various engine-cranking functions.

In addition to starting the engine, placing the ignition switch 15 in the IGN1 position also generates a voltage signal on signal line 25 that is used by other electronic modules. Specifically, some of the modules are only activated when the vehicle engine is started and running. When the engine has stopped, these modules can be required to move to a different operating mode.

Thus, as shown at FIG. 1, the voltage signal IGN1 on line 25 is provided to the powertrain control module 20 on line 25A, the airbag control module 21 on line 25B, the customer supplied module 23 on line 25C, the ABS module 24 on line 25D, and to the power mode module 17 on line 25E. Each of these modules relies on an accurate voltage for the signal IGN1 to determine the mode of operation for the particular module. In one specific example, the airbag module control 21 has an active and inactive state. In the active state, the module 21 provides control signals to the airbag components to permit their operation in the event of a vehicle crash. In its inactive state, the module 21 essentially deactivates the airbag system. To insure the safety of the occupants, the airbag control module 21 is in its inactive condition at least until the vehicle engine is running. In order to make this determination; the module 21 reads the signal IGN1 on signal line 25B. If that signal exceeds a predetermined threshold voltage, it is assumed that the ignition switch 15 is in its "run/crank" position and that the engine is in fact running.

However, as vehicle electrical systems become more complex, the actual voltage of the ignition signal IGN1 may be subject to transient fluctuations. It is therefore been necessary to incorporate active circuit components that receive and evaluate the ignition signal IGN1 to determine the on/off state of the vehicle ignition. In one typical system, a forward biased diode and resistor circuit is utilized to prevent negative transients from affecting the output voltage value. While this resistor-diode network addresses the problem of negative transients, it also introduces a certain degree of non-linearity and unpredictability. Some microcontrollers or electronic modules can handle widely varying ignition voltage signals. However, many other modules are more sensitive and require a more tightly toleranced voltage signal to be evaluated.

There is therefore a need for an ignition sensing system that addresses external transients that impact voltage signal without adding new errors to the output voltage signal.

SUMMARY OF THE INVENTION

In response to this need, the present invention provides a compensation circuit for use with an ignition voltage sensing circuit. The ignition sensing circuit includes an active filter element in series with a resistance element, which is configured to filter or block transients superimposed on the ignition voltage signal. In accordance with the preferred embodiment of the invention, the sensing circuit includes a forward biased diode and a resistor connected between an input receiving the ignition voltage signal and an output node. A second resistor is connected between the output node and ground. Prior to introduction of the inventive compensation circuit, the voltage signal at the output node is provided to a microprocessor of a control device that executes power molding based on the magnitude of the ignition voltage signal.

In accordance with one aspect of the invention, a compensation circuit includes a second active element, such as a diode, in series between the second resistor and ground. In an important feature of the invention, the second active element has substantially identical electrical properties and performance characteristics as the active filter element. In a specific embodiment, both elements constitute substantially identical diodes mounted on a common substrate. Thus, the voltage drop across both diodes is expected to be substantially identical under all environmental conditions, such as temperature.

The present invention capitalizes on the identity in diode performance to compensation for voltage errors in the sensed ignition voltage signal introduced by the active filter element. Thus, in accordance with a further feature of the invention, means are provided for subtracting the voltage drop across the compensation diode from the voltage signal at the first output node of the filter circuit. In the preferred embodiment, this means constitutes software instructions implemented by the microprocessor of the device acting on the ignition voltage signal. These software instructions implement the following equation based on particular values for the two resistors in the filter circuit: IGN1=4×(IGN_D1−(IGN_D2)+2), where IGN1 is the corrected ignition voltage, IGN_D1 is the voltage at the first output node, and IGN_D2 is the voltage at a node between the compensation diode and the second resistor. The corrected ignition voltage value can then be provided to the power moding and testing components of the device microprocessor.

It is one object of the invention to provide an ignition voltage sensing device that can eliminate unnecessary transient signals from the actual ignition voltage. A further object is achieved by features of the invention that compensates for or overcomes errors introduced into the sensed voltage signal by the voltage sensing device.

One benefit of the invention is that it is easily implemented within existing ignition voltage sensing devices. A further benefit is accomplished by aspects of the invention that addresses environmental effects on the voltage sensing device to provide an accurate signal to other devices relying upon ignition voltage.

These and other objects and benefits will become apparent upon consideration of the following written description of the present invention, together with the accompanying figures.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
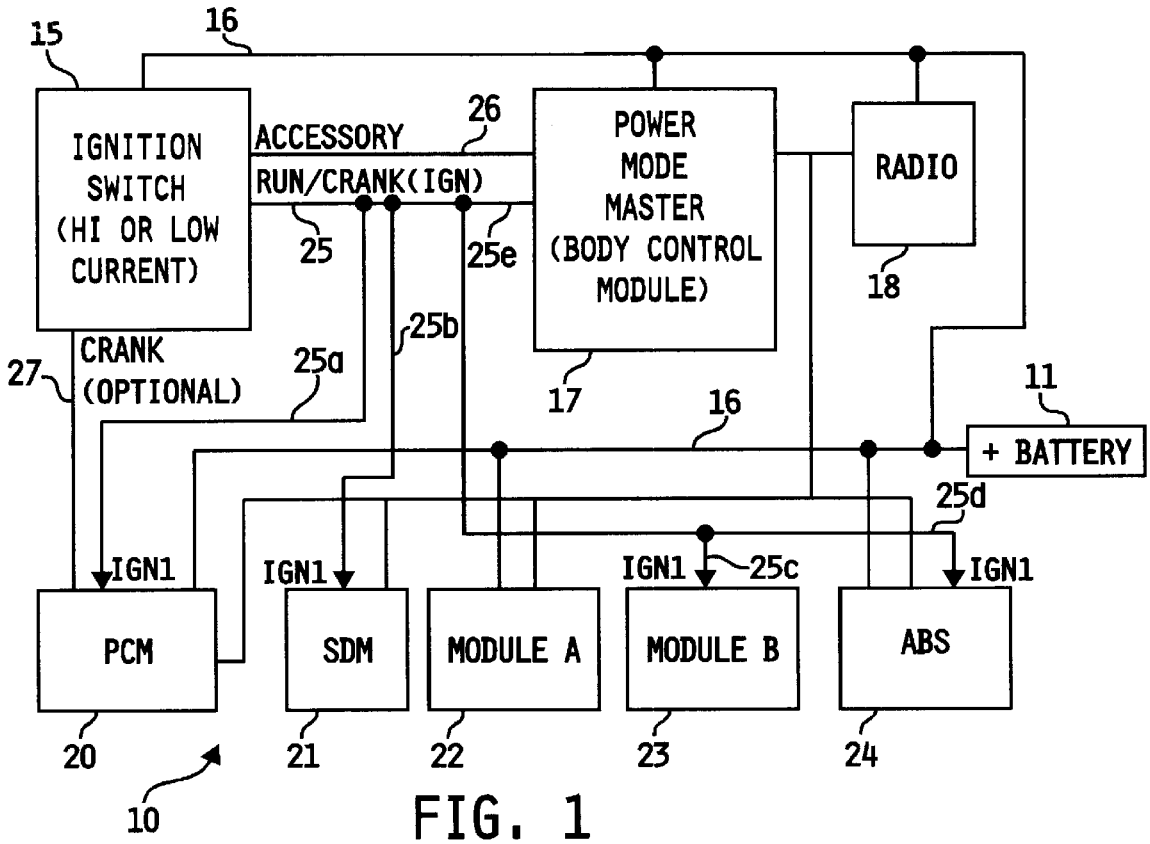
FIG. 1 is a block diagram of a vehicle electrical system that utilizes the ignition voltage sensing system of the present invention.

For the purposes of promoting an understanding of the principles of the invention, reference will now be made to preferred embodiments illustrated in the drawings and specific language will be used to describe the same. It will nevertheless be understood that no limitation of the scope of the invention is thereby intended, such alterations and further modifications in the illustrated embodiments, and such further applications of the principles of the invention as illustrated therein being contemplated as would normally occur to one skilled in the art to which the invention relates.

As indicated above, a typical vehicle electrical system, such as system 10' includes a number of control modules that monitor and administer various vehicle and engine functions. Most of these modules include digital control circuitry, a microcontroller or a microprocessor. In one type of the controller, namely the SDM or airbag controller 21, the magnitude of the voltage on signal line 25B, corresponds to the ignition voltage IGN1, determines the mode of operation of the module 21. Specifically, the module 21 is activated when the signal IGN1 exceeds a predetermined threshold value, and is de-activated when that signal falls below that threshold. This value is preferably based upon the run/crank voltage necessary for engine starting. For a typical engine, the magnitude of the signal IGN1 will be 10–12 volts. However, the ignition voltage on signal line 25 can vary between 0 to 20 volts in normal operation. In a specific application, the module 21 can be activated when IGN1 exceeds 10.0 volts and de-activated when IGN1 drops below 9.4 volts.

Figure 2:
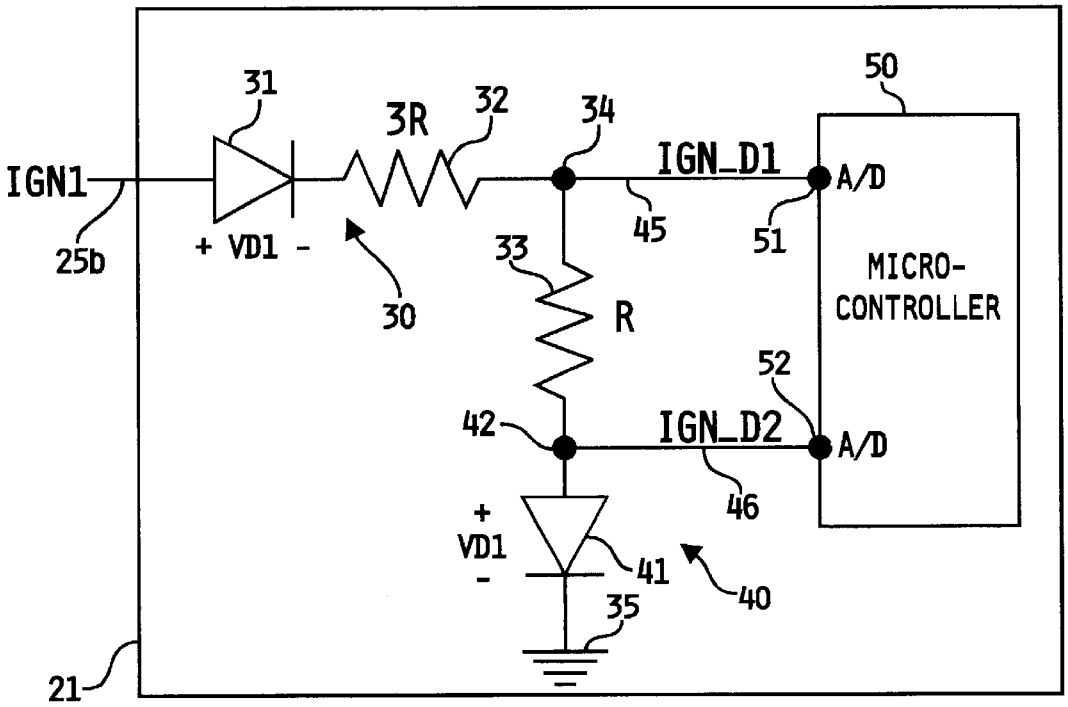
FIG. 2 is a circuit diagram of an ignition voltage sensing system according to one embodiment of the present invention.

In a typical control module, such as the airbag control module 21, a blocking circuit is provided for removing negative transients from the ignition signal IGN1. Thus, as depicted in the circuit diagram of FIG. 2, a blocking circuit 30 is connected to the ignition signal line 25B to receive the voltage signal IGN1 from ignition switch 15. In one embodiment, the blocking circuit 30 includes a blocking diode element 31 and a series resistance element 32. A second resistance element 33 is connected between a first output node 34 and ground 35.

The output node 34 in prior electrical systems has been tapped to provide a filtered ignition voltage signal. However, in many cases the blocking circuit 30 itself introduces additional non-linear errors into the voltage signal output at node 34. For example, temperature effects can cause wide variations in the voltage drop across the blocking circuit 30 and more particularly a block diode 31. In some instances, the voltage drop across diode element 31, VD1, can range from 0.4 to 1.2 volts.

For certain controllers, such as the airbag controller 21, this voltage variation can cause power moduling problems due to the tight tolerance in voltage thresholds applied by the module. For example, if the activation threshold for the module 21 is 10.0 volts, a voltage signal IGN1 on line 25B of 10 volts or more will indicate an ignition and run/crank condition to the module 21. If the magnitude of the signal IGN1 falls below a lower threshold of 9.4 volts, the module 21 will assume that the engine is no longer running and consequently deactivate the vehicle airbag control system. If this voltage drop occurs during, normal operation of the engine, i.e.—when the engine is shut off, the change in power mode of the module 21 is acceptable. However, if this voltage change occurs due to errors introduced by the blocking circuit 30, the airbag control module 21 will erroneously believe that the vehicle engine is no longer running. Thus, if the diode element 31 introduces a voltage drop of 1.2 volts to the ignition voltage IGN1 of 10 volts, the resulting 8.8 volt signal to the control circuitry of the airbag control module 21 will cause the module to respond as if the engine is no longer running. The risks associated with a de-activated airbag system in a running vehicle are apparent.

In order to address this problem, the present invention contemplates introducing an active electrical element as part of a compensation circuit 40. Specifically, the active element is a diode element 41 connected in series between the second resistor 33 and ground. In accordance with the preferred embodiment of the invention, the second diode element 41 is substantially identical to the first element diode 31 of the blocking circuit 30, so that the two diodes have substantially the same electrical performance and physical characteristics. In this instance, the voltage drop across the second diode element 41 should equal the voltage drop across the first diode element 31. In a further feature of the invention, the two diode elements 31 and 41 can be mounted on the same substrate so that they are physically proximate each other. Thus, they will both experience the same physical conditions—e.g., temperature, external EMF and vibration. Under these circumstances, the electrical response of the two diode elements are theoretically equal.

The compensation circuit 40 thus provides a way to accurately determine the true magnitude of the voltage signal IGN1 for use by the control module 21. Thus, in one further aspect of the invention, the compensation circuit 40 includes means for subtracting the voltage drop across the compensation diode element 41 from the voltage signal at the first output node 34. According to the preferred embodiment of the invention, a first output line 45 is connected to the node 34 which conveys the signal IGN_D1. A second output line 46 is connected to the second output node 42 in the compensation circuit 40. A voltage signal IGN_D2 is conveyed on this second output line.

The controller 21 includes a microprocessor or microcontroller 50 that ideally receives the ignition voltage signal IGN1 and applies various power mode tests to the signal. The microcontroller 50 includes additional inputs and a number of outputs (not shown) to perform the various functions of the airbag control module 21. According to the present invention, the micro controller 50 can include a pair of A/D inputs 51 and 52, with each input connected to a corresponding one of the output lines 45 and 46. Each of the inputs 51 and 52 is connected to circuitry within the microcontroller 50 to convert the analog voltage signals, IGN_D1 and IGN_D2 to a digital value for use by software within the microcontroller 50. Alternatively, the two output lines 45 and 46 can be connected to a common input and common A/D converter that is switched to receive and process a selected one of the two voltage signals.

In accordance with the preferred embodiment of the invention, the microcontroller 50 includes software instructions that process the incoming voltage signals IGN-D1, IGN-D2 to produce a compensated value for the ignition voltage signal IGN1. The software implemented by the micro controller 50 is dependent upon the values of the two resistors 32 and 33. In the preferred embodiment, the resistance element 32 has a resistance value of 3R, while the second resistance element 33 has a resistance value of 1R. Based on these resistance values, the software algorithm applies the equation IGN1=4×(IGN_D1−(IGN_D2)÷2) to obtain an accurate estimate of the ignition voltage. In one specific embodiment, the microcontroller 50 of the module 21 is programmed or configured to perform the following sequence of steps:

Perform A/D conversion for IGN_D1 (312.5 us interrupt):

Load IGN_D1 A/D channel to read

Start A/D conversion

IGN_D1_conversion=true

Schedule next interrupt to occur in 312.5 us

Store IGN_D1 result and perform A/D conversion for IGN_D2 (A/D interrupt):

If (IGN_D1_conversion=true) then
  IGN_D1=A/D_result
  IGN_D1_conversion=false
  Load IGN_D2 A/D channel to read
  Start A/D conversion
  IGN_D2_conversion=true Endif Store IGN_D2 result (A/D interrupt):

If (IGN_D2_conversion=true) then
  IGN_D2=A/D_result
  IGN_D2_conversion=false Endif Calculate IGN1 from A/D results (10 ms periodic task):

```
<temp>IGN_result = IGN_D2/2          /* Shift right to
                                divide IGN_D2 by 2 */
<temp>IGN_result = IGN_D1 - <temp>IGN_result
(IGN1/4) = <temp>IGN_result
IGN1 = 4%(IGN1/4)          /* (IGN1/4) is now available for
                                limit checking and other
                                program needs.*/
```

It should be noted that the final step in which the result of the subtraction is multiplied by four can be eliminated. In this case, the limit checking and associated routines conducted by the microcontroller 50 are modified to accept the voltage value IGN/4. It is contemplated that the above software algorithm would be executed continuously and preferably at predetermined interrupt intervals.

In the preferred embodiment, all of the components of the blocking circuit 30 and the compensation circuit 40 are mounted on a common substrate so that they all experience the same environmental conditions. With this arrangement, then, the voltage drop across the second diode element 41 should accurately reflect the voltage drop across the first diode element 31 in the blocking circuit 30. As the voltage drop across the blocking diode 31 changes, so should the voltage drop across the compensation diode element 41. Applying the equation implemented by the software described above insures that the other routines of the microcontroller 50 receive an accurate value for the ignition voltage IGN1.

In a specific embodiment of the invention, both diode elements 31 and 41 are type 1N4004 diodes. The resistors 32 and 33 are 3K ohm and 1K ohm, respectively, one quarter watt one percent resistors. With these components, the maximum error is expected to be 0.3 volts. This error can be further reduced by replacing the diode elements 31 and 41 with matched diode pairs, and/or by replacing the resistance elements 32 and 33 with a resistor array, such as a model CRA06E thick film resistor array.

While the invention has been illustrated and described in detail in the foregoing drawings and description, the same is to be considered as illustrative and not restrictive in character, it being understood that only one preferred embodiment there of has been shown and described an that all changes and modifications that come within the spirit of the invention are desired to be protected.

What is claimed is:

1. In a vehicle having an engine and an ignition system providing an ignition voltage signal to the engine, an ignition sensing circuit for providing a signal indicative of the ignition voltage to a device, the sensing circuit comprising:

an input for receiving the ignition voltage signal;

an active filter element electrically connected between said input and a first output node, said filter element configured to filter the ignition voltage signal;

an active compensation element electrically connected between said first output node and ground, wherein said compensation element is physically proximate said filter element and has substantially the same electrical performance characteristics as said filter element; and means for providing a compensated ignition voltage signal to the device by subtracting the voltage drop across said compensation element from the voltage at said first output node.

2. The ignition sensing circuit according to claim 1, wherein said means for providing a compensated ignition voltage signal includes:

a second output node electrically connected between said first output node and said compensation element, wherein said voltage drop across said compensation element is equivalent to the voltage at said second output node.

3. The ignition sensing circuit according to claim 2, in which the device includes a microprocessor having a first input connected to an A/D converter and a second input connected to an A/D converter, wherein:

said first output node is connected to the first input of the microprocessor;

said second output node is connected to the second input of the microprocessor; and said means for providing a compensated voltage signal includes subtraction means implemented by the microprocessor for subtracting a second A/D converted value for the voltage at said second output node from a first A/D converted value for the voltage at said first output node.

4. The ignition sensing circuit according to claim 1, further comprising:

a first resistance element connected in series between said filter element and said first output node; and a second resistance element connected in series between said first output node and said compensation element.

5. The ignition sensing circuit according to claim 4, wherein said first resistor element and said second resistor element are mounted on a common substrate.

6. The ignition sensing circuit according to claim 4, wherein said means for providing a compensated ignition voltage signal includes:

a second output node electrically connected between said second resistance element and said compensation element, wherein said voltage drop across said compensation element is equivalent to the voltage at said second output node.

7. The ignition sensing circuit according to claim 6, in which the device includes a microprocessor having a first input connected to an A/D converter and a second input connected to an A/D converter, wherein:

said first output node is connected to the first input of the microprocessor;

said second output node is connected to the second input of the microprocessor; and said means for providing a compensated voltage signal includes subtraction means implemented by the microprocessor for subtracting a second A/D converted value for the voltage at said second output node from a first A/D converted value for the voltage at said first output node.

8. The ignition sensing circuit according to claim 7, wherein:

said first resistance element has a resistance value 3R and said second resistance element has a resistance value 1R; and said subtraction means implemented by the microprocessor is operable to divide the second A/D converted value by two (2) prior to subtracting from the first A/D converted value.

9. The ignition sensing circuit according to claim 8, wherein said subtraction means implemented by the microprocessor is operable to multiply the result of said subtraction by four (4).

10. The ignition sensing circuit according to claim 1, wherein both said filter element and said compensation element are diodes.

11. The ignition sensing circuit according to claim 10, wherein both said filter element and said compensation element are forward biased.

12. The ignition sensing circuit according to claim 1, wherein said filter element and said compensation element are mounted on a common substrate.

13. The ignition sensing circuit according to claim 1, wherein both said filter element and said compensation element include dual diode rectifiers.

* * * * *